US010724357B2

(12) United States Patent
Kyllingstad

(10) Patent No.: US 10,724,357 B2
(45) **Date of Patent: *Jul. 28, 2020**

(54) METHOD AND DEVICE FOR ESTIMATING DOWNHOLE STRING VARIABLES

(71) Applicant: National Oilwell Varco Norway AS, Kristiansand S (NO)

(72) Inventor: Åge Kyllingstad, Ålgård (NO)

(73) Assignee: National Oilwell Varco Norway AS (NO)

( * ) Notice: Subject to any disclaimer, the term of this patent is extended or adjusted under 35 U.S.C. 154(b) by 0 days.

This patent is subject to a terminal disclaimer.

(21) Appl. No.: 16/385,148

(22) Filed: Apr. 16, 2019

(65) Prior Publication Data

US 2019/0242235 A1 Aug. 8, 2019

Related U.S. Application Data

(62) Division of application No. 15/316,422, filed as application No. PCT/NO2014/050094 on Jun. 5, 2014, now Pat. No. 10,309,211.

(51) Int. Cl.

| | |
|---|---|
| ***E21B 44/00*** | (2006.01) |
| ***E21B 47/00*** | (2012.01) |
| *E21B 3/02* | (2006.01) |

(52) U.S. Cl.

CPC ..... *E21B 44/00* (2013.01); *E21B 47/00* (2013.01); *E21B 3/02* (2013.01)

(58) Field of Classification Search

None

See application file for complete search history.

(56) References Cited

U.S. PATENT DOCUMENTS

| | | | | |
|---|---|---|---|---|
| 2,554,005 A * | 5/1951 | Bodine, Jr. | ..... | E21B 7/24 175/55 |
| 10,309,211 B2 * | 6/2019 | Kyllingstad | ..... | E21B 44/00 |
| 2011/0232966 A1 * | 9/2011 | Kyllingstad | ..... | E21B 44/00 175/24 |

FOREIGN PATENT DOCUMENTS

| | | | | |
|---|---|---|---|---|
| CA | 2 950 884 | * 12/2015 | ..... | E21B 44/00 |
| CA | 002950884 | * 12/2015 | ..... | E21B 44/00 |

OTHER PUBLICATIONS

Xingming Wang in Modeling Friction Performance of Drill String Torsional, 15 pages (Year: 2017).*

(Continued)

*Primary Examiner* — Tung S Lau

(74) *Attorney, Agent, or Firm* — Conley Rose, P.C.

(57) ABSTRACT

A method for estimating downhole speed and force variables at an arbitrary location of a moving drill string based on surface measurements of the same variables. The method includes a) using properties of said drill string to calculate transfer functions describing frequency-dependent amplitude and phase relations between cross combinations of said speed and force variables at the surface and downhole; b) selecting a base time period; c) measuring surface speed and force variables, conditioning the measured data by applying anti-aliasing and/or decimation filters, and storing the conditioned data, and d) calculating the downhole variables in the frequency domain by applying an integral transform, such as Fourier transform, of the surface variables, multiplying the results with said transfer functions, applying the inverse integral transform to sums of coherent terms and picking points in said base time periods to get time-delayed estimates of the dynamic speed and force variables.

20 Claims, 7 Drawing Sheets

(56) References Cited

OTHER PUBLICATIONS

Li Wei in Rock fragmentation mechanisms and an experimental study of drilling tools during high-frequency harmonic vibration, 7 pages (Year: 2013).*
Xinda Qi, A Novel Well Drill Assisted with High-Frequency Vibration Using the Bending Mode, 15 pages (Year: 2018).*
Elastic vibrations, 18 pages (Year: 2004).*

* cited by examiner

METHOD AND DEVICE FOR ESTIMATING DOWNHOLE STRING VARIABLES

CROSS-REFERENCE TO RELATED APPLICATIONS

This application is a divisional of U.S. patent application Ser. No. 15/316,422 filed Dec. 5, 2016, which is a 35 U.S.C. § 371 national stage entry of PCT/NO2014/050094, filed Jun. 5, 2014, both of which are incorporated herein by reference in their entirety for all purposes.

BACKGROUND

The present disclosure relates to a method for for estimating downhole speed and force variables at an arbitrary location of a moving drill string based on surface measurements of the same variables.

A typical drill string used for drilling oil and gas wells is an extremely slender structure with a corresponding complex dynamic behavior. As an example, a 5000 m long string consisting mainly of 5 inch drill pipes has a length/diameter ratio of roughly 40 000. Most wells are directional wells, meaning that their trajectory and target(s) depart substantially from a straight vertical well. A consequence is that the string also has relatively high contact forces along the string. When the string is rotated or moved axially, these contact forces give rise to substantial torque and drag force levels. In addition, the string also interacts with the formation through the bit and with the fluid being circulated down the string and back up in the annulus. All these friction components are non-linear, meaning that they do not vary proportionally to the speed. This non-linear friction makes drill string dynamics quite complex, even when we neglect the lateral string vibrations and limit the analysis to torsional and longitudinal modes only. One phenomenon, which is caused by the combination of non-linear friction and high string elasticity, is torsional stick-slip oscillations. They are characterized by large variations of surface torque and downhole rotation speed and are recognized as the root cause of many problems, such as poor drilling rate and premature failures of drill bits and various downhole tools. The problems seem to be closely related to the high rotation speed peaks occurring in the slip phase, suggesting there is a strong coupling between high rotation speeds and severe lateral vibrations. Above certain critical rotating speeds the lateral vibrations cause high impact loads from whirl or chaotic motion of the drill string. It is therefore of great value to be able to detect these speed variations from surface measurements. Although measurements-while-drilling (MWD) services sometimes can provide information on downhole vibration levels, the data transmission rate through mud pulse telemetry is so low, typically 0.02 Hz, that it is impossible to get a comprehensive picture of the speed variations.

Monitoring and accurately estimating of the downhole speed variations is important not only for quantification and early detection of stick-slip. It is also is a valuable tool for optimizing and evaluating the effect of remedial tools, such as software aiming at damping torsional oscillations by smart of the control of the top drive. Top drive is the common name for the surface actuator used for rotating the drill string.

Prior art in the field includes two slightly different methods disclosed in the documents US2011/0245980 and EP2364397. The former discloses a method for estimating instantaneous bit rotation speed based on the top drive torque. This torque is corrected for inertia and gear losses to provide an indirect measurement of the torque at the output shaft of the top drive. The estimated torque is further processed by a band pass filter having its center frequency close to the lowest natural torsional mode of the string thus selectively extracting the torque variations originating from stick-slip oscillation. Finally, the filtered torque is multiplied by the torsional string compliance and the angular frequency to give the angular dynamic speed at the low end of the string. The method gives a fairly good estimate of the rotational bit speed for steady state stick-slip oscillations, but it fails to predict speed in transient periods of large surface speed changes and when the torque is more erratic with a low periodicity.

The latter document describes a slightly improved method using a more advanced band pass filtering technique. It also estimates an instantaneous bit rotation speed based upon surface torque measurements and it focuses on one single frequency component only. Although it provides an instantaneous bit speed, it is de facto an estimate of the speed one half period back in time which is phase projected to present time. Therefore it works fairly well for steady state stick-slip oscillations but it fails in cases where the downhole speed and top torque is more erratic.

In addition to giving poor results in transient periods, for example during start-ups and changes of the surface rotation speed, the above methods also have the weakness that the accuracy of the downhole speed estimate depends on the type of speed control. Soft speed control with large surface speed variations gives less reliable downhole speed estimates. This is because the string and top drive interact with each other and the effective cross compliance, defined as the ratio of string twist to the top torque, depends on the effective top drive mobility.

SUMMARY

This disclosure has for its object to remedy or to reduce at least one of the drawbacks of the prior art, or at least provide a useful alternative to prior art.

The object is achieved through features which are specified in the description below and in the claims that follow.

In a first aspect an embodiment of the invention relates to a method for estimating downhole speed and force variables at an arbitrary location of a moving drill string based on surface measurements of the same variables, wherein the method comprises the steps of:

a) using geometry and elastic properties of said drill string to calculate transfer functions describing frequency-dependent amplitude and phase relations between cross combinations of said speed and force variables at the surface and downhole;

b) selecting a base time period;

c) measuring, directly or indirectly, surface speed and force variables, conditioning said measured data by applying anti-aliasing and/or decimation filters, and storing the conditioned data in data storage means which keep said conditioned surface data measurements at least over the last elapsed base time period, d) when updating of said data storage means, calculating the downhole variables in the frequency domain by applying an integral transform, such as the Fourier transform, of the surface variables, multiplying the results with said transfer functions, applying the inverse integral transform to sums of coherent terms and picking points in said base time periods to get time-delayed estimates of the dynamic speed and force variables.

Coherent terms in this context means terms representing components of the same downhole variable but originating from different surface variables.

Mean speed equals the mean surface speed and the mean force equals to mean surface force minus a reference force multiplied by a depth factor dependent on wellbore trajectory and drill string geometry.

In a preferred embodiment the above-mentioned integral transform may be a Fourier transform, but the embodiments of the invention are not limited to any specific integral transform. In an alternative embodiment a Laplace transform could be used.

A detailed description of how the top drive can be smartly controlled based on the above-mentioned estimated speed and force variables will not be given herein, but the reference is made to the following documents for further details: WO 2013/112056, WO 2010064031 and WO 2010063982, all assigned to the present applicant and U.S. Pat. Nos. 5,117,926 and 6,166,654 assigned to Shell International Research.

In a second aspect the invention relates to a system for estimating downhole speed and force variables at an arbitrary location of a moving drill string based on surface measurements of the same variables, the system comprising:

a drill string moving means;

speed sensing means for sensing said speed at or near the surface;

force sensing means for sensing said force at or near the surface;

a control unit for sampling, processing and storing, at least temporarily, data collected from said speed and force sensing means, wherein the control unit further is adapted to:

using geometry and elastic properties of said drill string to calculate transfer functions describing frequency-dependent amplitude and phase relations between cross combinations of said speed and force variables at the surface and downhole;

selecting, or receiving as an input, a base time period;

conditioning data collected by said speed and force sensing means by applying anti-aliasing and/or decimation filters, and storing said conditioned surface data measurements at least over the last elapsed base time period; and when updating said stored data, calculating the downhole variables in the frequency domain by applying an integral transform, such as the Fourier transform, of the surface variables, multiplying the results with said transfer functions, applying the inverse integral transform to sums of coherent terms, and picking points in said base time period to get time-delayed estimates of the dynamic speed and force variables.

BRIEF DESCRIPTION OF THE DRAWINGS

In the following is described an example of a preferred embodiment, and Test results are illustrated in the accompanying drawings, wherein.

DETAILED DESCRIPTION

Figure 1:
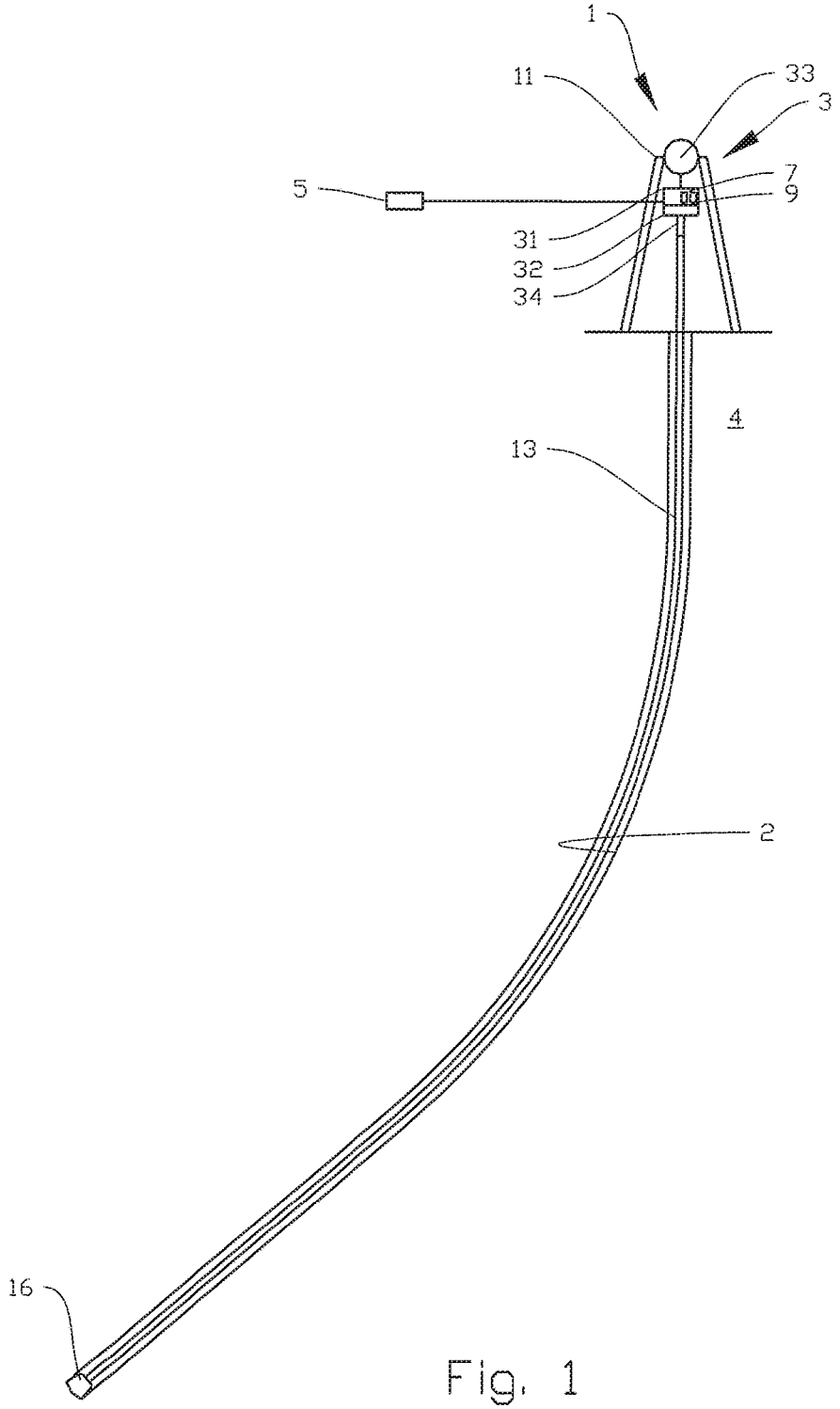
FIG. 1 shows a schematic representation of a system according to various embodiments of the present invention.

Some major improvements provided by the embodiments of the present invention over the prior art are listed below:

It resolves the causality problem by calculating delayed estimates of downhole variables, not instant estimates that neglect the finite wave propagation time.

It includes a plurality of frequency components, not only the lowest natural frequency.

It provides downhole torque, not only rotation speed.

It applies to any string location, not only to the lower end.

It can handle any top end condition with virtually any speed variation, not only the nearly fixed end condition with negligibly small surface speed variations.

It applies also for axial and hydraulic modes, not only for the angular mode.

For convenience, the analysis below will be limited to the angular mode and estimation of rotational speed and torque. Throughout we shall, for convenience, use the short terms "speed" in the meaning of rotational speed. Also we shall use the term "surface" in the meaning top end of the string. Top drive is the surface actuator used for rotating the drill string.

Some embodiments of the invention are explained by 5 steps described in some detail below.

Step 1: Treat the String as a Linear Wave Guide

In the light of what was described in the introduction about non-linear friction and non-linear interaction with the fluid and the formation, it may seem self-contradictory to treat the string as a linear wave guide. However, it has proven to be a very useful approximation and it is justified by the fact that non-linear effects often can be linearized over a substantial range of values. The wellbore contact friction force can be treated as a Coulomb friction which has a constant magnitude but changes direction on speed reversals. When the string rotation speed is positive, the wellbore friction torque and the corresponding string twist are constant. The torque due to fluid interaction is also non-linear but in a different way. It increases almost proportionally to the rotation speed powered with an exponent being typically between 1.5 and 2. Hence, for a limited range of speeds the fluid interaction torque can be linearized and approximated by a constant term (adding to the wellbore torque) plus a term proportional to the deviation speed, which equals the speed minus the mean speed. Finally, the torque generated at the bit can be treated as an unknown source of vibrations. Even though the sources of vibrations represent highly non-linear processes the response along the string can be described with linear theory. The goal is to describe both the input torque and the downhole rotation speed based on surface measurements. In cases with severe stick-slip, that is, when the rotation speed of the lower string end toggles between a sticking phase with virtually zero rotation speed and a slip phase with a positive rotation speed, the non-linearity of the wellbore friction cannot be neglected. However, because the bottom hole assembly (BHA) is torsionally much stiffer than drill pipes, it can be treated as lumped inertia and the variable BHA friction torque adds to the torque input at the bit.

It is also assumed that the string can be approximated by a series of a finite number, n, of uniform sections. This assumption is valid for low to medium frequencies also for sections that are not strictly uniform, such as drill pipes with regularly spaced tool joints. This is discussed in more detail below. Another example is the BHA, which is normally not uniform but consists of series of different tools and parts. The uniformity assumption is good if the compliance and inertia of the idealized BHA match the mean values of the real BHA.

Step 2: Construct a Linear System of Equations.

The approximation of the string as a linear wave guide implies that the rotation speed or torque can be described as a sum of waves with different frequencies. Every frequency component can be described by a set of 2n partial waves as will be described below, where n is the number of uniform sections.

Derivation or explicit description of the wave equation for torsional waves along a uniform string can be found in many text books on mechanical waves and is therefore not given here. Here we start with the fact that a transmission line is a power carrier and that this power can written as the product of a "forcing" variable and a "response" variable. In this case the forcing variable is torque while the response variable is rotation speed. Power is transmitted in both directions and is therefore represented by the superposition of two progressive waves for each variable, formally written as $$\Omega(t,x)=\Re\{\Omega_{\downarrow}e^{j\omega t-jkx}+\Omega_{\uparrow}e^{j\omega t+jkx}\} \tag{1}$$

$$T(t,x)=\Re\{Z\Omega_{\downarrow}e^{j\omega t-jkx}-Z\Omega_{\uparrow}e^{j\omega t+jkx}\} \tag{2}$$

Here $\Omega_{\downarrow}$ and $\Omega_{\uparrow}$ represent complex amplitudes of respective downwards and upwards propagating waves (subscript arrows indicate direction of propagation), Z is the characteristic torsional impedance (to be defined below), ω is the angular frequency, k=ω/c the wave number (c being the wave propagation speed), $j=\sqrt{-1}$ is the imaginary unit and $\Re$ is the real part operator (picking the real part of the expression inside the curly brackets). The position variable x is here defined to be positive downwards (along the string) and zero at the top of string. In the following we shall, for convenience, omit the common time factor $e^{j\omega t}$ and the linear real part operator $\Re$. Then the rotation speed and torque are represented by the complex, location-dependent amplitudes $$\hat{\Omega}(x)=\Omega_{\downarrow}e^{-jkx}+\Omega_{\uparrow}e^{jkx}, \text{ and} \tag{3}$$

$$\hat{T}(x)=Z\Omega_{\downarrow}e^{-jkx}-Z\Omega_{\uparrow}e^{jkx} \tag{4}$$

respectively.

The characteristic torsional impedance is the ratio between torque and angular speed of a progressive torsional wave propagating in positive direction. Hereinafter torsional impedance will be named just impedance. It can be expressed in many ways, such as $$Z=cpI=\sqrt{G\rho}\cdot I=\frac{GI}{c}=\frac{GI}{\omega}k \tag{5}$$

where ρ is the density of pipe material, $I=\pi(D^4-d^4)/32$ is the polar moment of inertia (D and d being the outer and inner diameters, respectively) and G is the shear modulus of elasticity. This impedance, which has the SI unit of Nms, is real for a lossless string and complex if linear damping is included. The effects of tool joints and linear damping are discussed in more detail below.

The general, mono frequency solution for a complete string with n sections consists of 2n partial waves represented by the complex wave amplitudes set $\{\Omega_{\downarrow i},\Omega_{\uparrow i}\}$, where the section index i runs over all n sections. These amplitudes can be regarded as unknown parameters that must be solved from a set of 2n boundary conditions: 2 external (one at each end) and 2n−2 internal ones.

The top end condition (at x=0) can be derived as from the equation of motion of the top drive. Details are skipped here but it can be written in the compact form $$\Omega_{\downarrow 1}+\Omega_{\uparrow 1}=m_t(\Omega_{\downarrow 1}-\Omega_{\uparrow 1}) \tag{6}$$

where $m_t$ is a normalized top drive mobility, defined by $$m_t\equiv\frac{Z_1}{Z_{td}}=\frac{Z_1}{P+\frac{I}{j\omega}+j\omega J} \tag{7}$$

Here $Z_1$ is the characteristic impedance of the upper string section, $Z_{td}$ represents the top drive impedance, P and I are respective proportional and integral factors of a PI type speed controller, and J is the effective mechanical inertia of the top drive.

From the above equation we see that $m_t$ becomes real and reaches its maximum when the angular frequency equals $\omega=\sqrt{J/I}$. From the top boundary condition (6), which can be transformed to the top reflection coefficient, $$r_t\equiv\frac{\Omega_{\downarrow 1}}{\Omega_{\uparrow 1}}=\frac{m_t-1}{m_t+1} \tag{8}$$

we also deduce that $r_t$ is real and that its modulus $|r_t|$ has a minimum at the same frequency. A modulus of the reflection coefficient less than unity means absorption of the torsional wave energy and damping of torsional vibrations. This fact is used as a basis for tuning the speed controller parameters so that the top drive mobility is nearly real and sufficiently high at the lowest natural frequency. Dynamic tuning also means that the mobility may change with time. This is also a reason that experimental determination of the top drive mobility is preferred over the theoretical approach.

If we denote the lower boundary position of section number i by $x_i$, then speed and torque continuity across the internal boundaries can be expressed mathematically by respective $$\Omega_{\downarrow i}e^{-jk_ix_i}+\Omega_{\uparrow i}e^{jk_ix_i}=\Omega_{\downarrow i+1}e^{-jk_{i+1}x_i}, \text{ and} \tag{9}$$

$$Z_i\Omega_{\downarrow i}e^{-jk_ix_i}-Z_i\Omega_{\uparrow i}e^{jk_ix_i}=Z_{i+1}\Omega_{\uparrow i+1}e^{-jk_{i+1}x_i}-Z_{i+1}\Omega_{\uparrow i+1}e^{jk_{i+1}x_i} \tag{10}$$

At the lower string end the relevant boundary condition is that torque equals a given (yet unknown) bit torque:

$$Z_n\Omega_{\downarrow n}e^{-jk_nx_n}-Z_n\Omega_{\uparrow n}e^{jk_nx_n}=T_b \tag{11}$$

All these external and internal boundary conditions can be rearranged and represented by a 2n×2n matrix equation $$A\cdot\Omega=B \tag{12}$$

where the system matrix A is a band matrix containing all the speed amplitude factors, $\Omega=(\Omega_{\downarrow 1}, \Omega_{\uparrow 1}, \Omega_{\downarrow 2}, \Omega_{\uparrow 2} \ldots \Omega_{\uparrow n})'$ is the speed amplitude vector and $B=(0,0, \ldots 0, T_b)'$ is the excitation vector. The prime symbol ' denotes the transposition implying that unprimed bold vector symbols represent column vectors.

Provided that the system matrix is non-singular, which it always is if damping is included, the matrix equation above can be solved to give the formal solution $$\Omega=A^{-1}B \tag{13}$$

This solution vector contains 2n complex speed amplitudes that uniquely define the speed and torque at any position along the string.

Step 3: Calculate Cross Transfer Functions.

The torque or speed amplitude at any location can be formally written as the (scalar) inner product of the response (row) vector $V_x'$ and the solution (column) vector, that is $$\hat{V}_x = V_x'\Omega = V_x'A^{-1}B \tag{14}$$

As an example, the speed at a general position x is represented by $V_x'=\Omega_x'=(0,0, \ldots e^{-jk_ix}, e^{jk_ix} \ldots)$ where subscript$_i$ denotes the section satisfying $x_{i-1} \le x \le x_i$. Similarly, the surface torque can be represented by $T_0'=(Z_1, -Z_1, 0, \ldots 0)$. The transfer function defining the ratio between two general variables, $\hat{V}_x$ and $\hat{W}_y$ at respective locations x and y, can be expressed as $$H_{vw} \equiv \frac{\hat{V}_x}{\hat{W}_y} = \frac{V'A^{-1}B}{W'A^{-1}B} \tag{15}$$

From the surface boundary condition (6) it can be seen that the system matrix can be written as the sum of a base matrix $A_0$ representing the condition with zero top mobility and a deviation matrix equal to the normalized top mobility times the outer product of two vectors. That is, $$A = A_0 + m_t UD' \tag{16}$$

where $U=(1,0,0, \ldots 0)'$ and $D'=(1,-1,0, \ldots 0)$. According to the Sherman-Morrison formula in linear algebra the inverse of this matrix sum can be written as $$A^{-1} = A_0^{-1} - \frac{m_t A_0^{-1} UD' A_0^{-1}}{1 + m_t D' A_0^{-1} U} = \frac{A_0^{-1} - m_t (D' A_0^{-1} U - A_0^{-1} UD') A_0^{-1}}{1 + m_t D' A_0^{-1} U} \tag{17}$$

The last expression is derived from the fact that $m_t D' A_0^{-1} U$ is a scalar. By introducing the zero mobility vectors $\Omega_0 = A_0^{-1}B$ and $U_0 = A_0^{-1}U$ the transfer function above can be written as $$H_{vw} = \frac{V'\Omega_0 + m_t(D'U_0V' - V'U_0D')\Omega_0}{W'\Omega_0 + m_t(D'U_0W' - W'U_0D')\Omega_0} = \frac{H_{vw,0} + H_{vw,1}m_t}{1 + C_{vw}m_t} \tag{18}$$

The last expression is obtained by dividing each term by $W'\Omega_0$. Explicitly, the scalar functions in the last expression are $H_{vw,0} = V'\Omega_0/W'\Omega_0$, $H_{vw,1} = (D'U_0V' - V'U_0D')/W'\Omega_0$ and $C_{vw} = (D'U_0W' - W'U_0D')/W'\Omega_0$. For transfer functions where the denominator represents the top torque, the response function $W'=T_0'$ is proportional to D', thus making $D'U_0W' = W'U_0D'$ and $C_{vw}=0$. The cross mobility and cross torque functions can therefore be written as $$M_x \equiv \frac{\hat{\Omega}(x)}{\hat{T}(0)} = \frac{\Omega_x'\Omega_0}{T_0'\Omega_0} + \frac{(D'U_0\Omega_x' - \Omega_x'U_0D')\Omega_0}{T_0'\Omega_0} m_t \equiv M_{x,0} + M_{x,1}m_t, \tag{19}$$

and $$H_x \equiv \frac{\hat{T}(x)}{\hat{T}(0)} = \frac{T_x'\Omega_0}{T_0'\Omega_0} + \frac{(D'U_0T_x' - T_x'U_0D')\Omega_0}{T_0'\Omega_0} m_t \equiv H_{x,0} + H_{x,1}m_t, \tag{20}$$

respectively.

These transfer functions are independent of magnitude and phase of the excitation torque but dependent on excitation and measurement locations.

The normalized top mobility can also be regarded as a transfer function. When both speed and torque are measured at top of the string, the top drive mobility can be found experimentally as the Fourier transform of the speed divided by the Fourier transform of the negative surface torque. If surface string torque is not measured directly, it can be measured indirectly from drive torque and corrected for inertia effects. The normalized top mobility can therefore be written by the two alternative expressions.

$$m_t = -\frac{Z_1\hat{\Omega}_t}{\hat{T}_t} = -\frac{Z_1\hat{\Omega}_t}{\hat{T}_d - i\omega J \cdot \hat{\Omega}_t} \tag{21}$$

Here a $\hat{\Omega}_t$, $\hat{T}_t$ and $\hat{T}_d$ represent complex amplitudes or Fourier coefficients of measured speed, string torque and drive torque, respectively. Recall that the normalized top mobility can be determined also theoretically from the knowledge of top drive inertia and speed controller characteristics.

Step 4: Calculate Dynamic Speed and Torque.

Because we have assumed that both the top torque and top speed are linear responses of torque input variations at the bit, the transfer functions above can be used for estimating both the rotation speed and the torque at the chosen location:

$$\hat{\Omega}_x = M_x\hat{T}_t = (M_{x,0} + M_{n,1}m_t)\hat{T}_t = M_{x,0}\hat{T}_t + M_{x,1}Z_1\hat{O}_t \tag{22}$$

$$\hat{T}_x = H_x\hat{T}_t = (H_{x,0} + H_{x,1}m_t)\hat{T}_t = H_{x,0}\hat{T}_t + H_{x,1}Z_1\hat{O}_t \tag{23}$$

Because of the assumed linearity this expression holds for any linear combination of frequency components. An estimate for the real time variations of the downhole speed and torque can therefore be found by superposition of all frequencies components present in the original surface signals. This can be formulated mathematically either as an explicit sum of different frequency components, or by the use of the discrete Fourier and inverse Fourier transforms $$\Omega(x, t) = \sum_{\omega_i} \Re\{M_x T_t e^{j\omega_i t}\} = F^{-1}\{M_x F\{T_t(t)\}\} \tag{24}$$

$$T(x, t) = \sum_{\omega_i} \Re\{H_x T_t e^{j\omega_i t}\} = F^{-1}\{H_x F\{T_t(t)\}\} \tag{25}$$

These transforms must be used with some caution because the Fourier transform presumes that the base signals are periodic while, in general, the surface signals for torque and speed are not periodic. This lack of periodicity causes the estimate to have end errors which decrease towards the center of the analysis window. Therefore, preferably the center sample $t_c = t - t_w/2$, or optionally samples near the center of the analysis window, should be used, $t_w$ denoting the size of the analysis window.

Step 5: Add Static Components.

The static (zero frequency) components are not included in the above formulas and must therefore be treated separately. For obvious reasons the average rotation speed must be the same everywhere along the string. Therefore the zero frequency downhole speed equals the average surface speed. The only exception of this rule is during start-up when the string winds up and the lower string is still. A special logic should therefore be used for treating the start-up cases separately. One possibility is to set the downhole speed equal to zero until the steadily increasing surface torque reaches the mean torque measured prior to the last stop.

One should also distinguish between lower string speed and bit speed because the latter is the sum of the former plus the rotation speed from an optional, fluid-driven positive displacement motor, often called a mud motor. Such a mud motor, which placed just above the bit, is a very common string component and is used primarily for directional control but also for providing additional speed and power to the bit.

In contrast to the mean string speed, the mean torque varies with string position. It is beyond the scope here to go into details of how to calculate the static torque level, but it can be shown that a static torque model can be written on the following form.

$$T_w(x)=(1-f_T(x))\cdot T_{w0}+T_{bit} \tag{26}$$

where $T_{w0}$ is the theoretical (rotating-off-bottom) wellbore torque, $T_{bit}$ is the bit torque and $f_T(x)$ is a cumulative torque distribution factor. This factor can be expressed mathematically by $$f_T(x)=\frac{\int_0^x \mu F_c r_c dx}{\int_0^{x_n} \mu F_c r_c dx} \tag{27}$$

where $\mu$, $F_c$, and $r_c$ denotes wellbore friction coefficient, contact force per unit length and contact radius, respectively. This factor increases monotonically from zero at surface to unity at the lower string end. It is a function of many variables, such as the drill string geometry well trajectory but is independent of the wellbore friction coefficient. Therefore, it can be used also when the observed (off bottom) wellbore friction torque, $\overline{T}_{t0}$, deviates from the theoretical value $T_{w0}$. The torque at position x can consequently be estimated as the difference $\overline{T}_t-f_T(x)\overline{T}_{t0}$, where $\overline{T}_t$ represents the mean value of the observed surface torque over the last analysis time window.

The final and complete estimates for downhole rotation speed and torque can be written in the following compact form:

$$\Omega(x,t_c)=F_c^{-1}\{M_{x,0}F\{T_t(t)\}+M_{x,1}Z_1F\{\Omega_t(t)\}\}+\overline{\Omega}_t \tag{28}$$

$$T(x,t_c)=F_c^{-1}\{H_{x,0}F\{T_t(t)\}+H_{x,1}Z_1F\{\Omega_1(t)\}\}+\overline{T}_t-f_T(x)\overline{T}_{t0} \tag{29}$$

Here $F_c^{-1}$ means the center or near center sample of the inverse Fourier transform. The two terms inside the outer curly brackets in the above equations are here called coherent terms, because each pair represents components of the same downhole variable arising from complementary surface variables.

Application to Other Modes

The formalism used above for the torsional mode can be applied also to other modes, with only small modifications. When applied to the axial mode torque and rotation speed variables (T,Ω) must be substituted by the tension and longitudinal speed (F,V), and the characteristic impedance for torsional waves must be substituted by $$Z=c\rho A=\sqrt{E\rho}\cdot A=\frac{EA}{c}=\frac{EA}{\omega}k \tag{30}$$

Here $c=\sqrt{E/\rho}$ now denotes the sonic speed for longitudinal waves, $A=\pi(D^2-d^2)/4$ is the cross sectional area of the string and E is the Young's modulus of elasticity. If the tension and axial speed is not measured directly at the string top but in the dead line anchor and the draw works drum, there will be an extra challenge in the axial mode to handle the inertia of the traveling mass and the variable (block height-dependent) elasticity of the drill lines. A possible solution to this is to correct these dynamic effects before tension and hoisting speed are sampled and stored in their circular buffers.

The dynamic axial speed and tension force estimated with the described method are most accurate when the string is either hoisted or lowered. If the string is reciprocated (moved up and down), the accompanied speed reversals will make wellbore friction change much so it is no longer constant as this method presumes. This limitation vanishes in nearly vertical wells because of the low wellbore friction.

The method above also applies when the lower end is not free but fixed, like it is when the bit is on bottom, provided that the lower end condition (9) is substituted by $$V_{\downarrow n}e^{-jk_nx_n}+V_{\uparrow n}e^{jk_nx_n}=V_b \tag{31}$$

The inner pipe or the annulus can be regarded as transmission lines for pressure waves. Again the formalism above can be used for calculating downhole pressures and flow rates based on surface measurements of the same variables. Now the variable pair (T,Ω) must be substituted by pressure and flow rate (P,Q) while the characteristic impedance describing the ratio of those variables in a progressive wave is $$Z=\frac{c\rho}{A}=\frac{\sqrt{B\rho}}{A}=\frac{B}{cA}=\frac{B}{A\omega}k \tag{32}$$

Here ρ denotes the fluid density, B is the bulk modulus, $c=\sqrt{B/\rho}$ now denotes the sonic speed for pressure waves, A is the inner or annular fluid cross-sectional area. A difference to the torsional mode is that the lower boundary condition is more like the fixed than a free end for pressure waves. Another difference is that the linearized friction is flow rate-dependent and relatively higher than for torsional waves.

Modelling of Tool Joints Effects.

Normal drill pipes are not strictly uniform but have screwed joints with inner and outer diameters differing substantial from the corresponding body diameters. However, at low frequencies, here defined as frequencies having wave lengths much longer than the single pipes, the pipe can be treated as uniform. The effective characteristic impedance can be found by using the pipe body impedance times a tool joint correction factor. It can be seen that the effective impedance, for any mode, can be calculated as $$Z=Z_b\sqrt{\frac{1-l_j+l_jz_j}{1-l_j+l_j/z_j}} \tag{33}$$

Where $Z_b$ is the impedance for the uniform body section, $l_j$ is the relative length of the tool joints (typically 0.05), and $z_j$ is the joint to body impedance ratio. For the torsional mode the impedance ratio is given by the ratio of polar moment of inertia, that is, $z_j=(D_j^4-d_j^4)/(D_b^4-d_b^4)$, where $D_j$, $d_j$, $D_b$ and $d_b$, are outer joint, inner joint, outer body and inner body diameters, respectively. A corresponding formula for the axial impedance is obtained simply by substituting the diameter exponents 4 by 2. For the characteristic hydraulic impedance for inner pressure the relative joint impedance equals $z_j=d_b^2/d_j^2$.

Similarly, the wave number of a pipe section can be written as the strictly uniform value $k_0=\omega/c_0$ multiplied by a joint correction factor $f_j$:

$$k = \frac{\omega}{c_0}\sqrt{1 + l_j(1 - l_j)\left(z_j + \frac{1}{z_j} - 2\right)} \equiv k_0 f_j \tag{34}$$

Note that the correction factor is symmetric with respect to joint and body lengths and with respect to the impedance ratio. A repetitive change in the diameters of the string will therefore reduce the wavelength and the effective wave propagation speed by a factor $1/f_j$. As an example, a standard and commonly used 5 inch drill pipe has a typical joint length ratio of $l_j=0.055$ and a torsional joint to body impedance ratio of $z_j=5.8$. These values result in a wave number correction factor of $f_j=1.10$ and a corresponding impedance correction factor of $Z/Z_b=1.15$. Tool joint effects should therefore not be neglected.

In practice, the approximation of a jointed pipe by a uniform pipe of effective values for impedance and wave number is valid when $k\Delta L<\pi/2$ or, equivalently, for frequencies $f<c/(4\Delta L)$. Here $\Delta L\approx 9.1$m is a typical pipe length. For the angular mode having a sonic speed of about $c\approx 3100$ m/s it means a theoretical frequency limit of roughly 85 Hz. The practical bandwidth is much lower, typical 5 Hz.

Modelling of Damping Effects.

Linear damping along the string can be modelled by adding an imaginary part to the above lossless wave number. A fairly general, two parameter linear damping along the string can be represented by the following expression for the wave number $$k = f_j \frac{1 + j\delta}{c_0}(\omega + j\gamma) \tag{35}$$

The first damping factor $\delta$ represents a damping that increases proportionally to the frequency, and therefore reduces higher mode resonance peaks more heavily than the lowest one. The second type of damping, represented by a constant decay rate $\gamma$, represents a damping that is independent of frequency and therefore dampens all modes equally. The most realistic combination of the two damping factors can be estimated experimentally by the following procedure. Experience has shown that when the drill string is rotating steadily with stiff top drive control, without stick-slip oscillation and with the drill bit on bottom, then the bit torque will have a broad-banded input similar to white noise. The corresponding surface torque spectrum will then be similar to the response spectrum shown in FIG. 3 below, except for an unknown bit torque scaling factor. By using a correct scaling factor (white noise bit excitation amplitude) and an optimal combination of $\delta$ and $\gamma$ one can get a fairly good match between theoretic and observed spectrum. The parameter fit procedure can either be a manual trial and error method or an automatic method using a software for non-linear regression analysis.

Since the real damping along the string is basically non-linear, the estimated damping parameters $\delta$ and $\gamma$ can be functions many parameters, such as average speed, mud viscosity and drill string geometry. Experience has shown that the damping, for torsional wave at least, is relatively low meaning that $\delta<<1$ and $\gamma<<\omega$. Consequently, the damping can be set to zero or to a low dummy value without jeopardizing the accuracy of the described method.

One Possible Algorithm for Practical Implementation

FIG. 1 shows, in a schematic and simplified view, a system 1 according to embodiments of the present invention. A drill string moving means 3 is shown provided in a drilling rig 11. The drill string moving means 3 includes an electrical top drive 31 for rotating a drill string 13 and draw works 33 for hoisting the drill string 13 in a borehole 2 drilled into the ground 4 by means of a drill bit 16. The top drive 31 is connected to the drill string 13 via a gear 32 and an output shaft 34. A control unit 5 is connected to the drill string moving means 3, the control unit 5 being connected to speed sensing means 7 for sensing both the rotational and axial speed of the drill string 13 and force sensing means 9 for sensing the torque and tension force in the drill string 13. In the shown embodiment both the speed and force sensing means 7, 9, are embedded in the top drive 31 and wirelessly communicating with the control unit 5. The speed and force sensing means 7, 9 may include one or more adequate sensors as will be known to a person skilled in the art. Rotation speed may be measured at the top of the drill string 13 or at the top drive 31 accounting for gear ratio. The torque may be measured at the top of the drill string 13 or at the top drive 31 accounting for inertia effects as was discussed above. Similarly, the tension force and axial velocity may be measured at the top of the drill string 13, or in the draw works 33 accounting for inertia of the moving mass and elasticity of drill lines, as was also discussed above. The speed and force sensing means 7, 9 may further include sensors for sensing mud pressure and flow rate in the drill string 13 as was discussed above. The control unit 5, which may be a PLC (programmable logic controller) or the like, is adapted to execute the following algorithm which represents an embodiment of the invention, applied to the torsional mode and to any chosen location within the string, $0<x\leq x_n$. It is assumed that the output torque and the rotation speed of the top drive are accurately measured, either directly or indirectly, by the speed and force sensing means 5, 7. It is also taken for granted that these signals are properly conditioned. Signal conditioning here means that the signals are 1) synchronously sampled with no time shifts between the signals, 2) properly anti-aliasing filtered by analogue and/or digital filters and 3) optionally decimated to a manageable sampling frequency, typically 100 Hz.

1) Select a constant time window $t_w$, typically equal to the lowest natural period of the drill string and $n_s$ (integer) samples, serves as the base period for the subsequent Fourier analysis.
2) Approximate the string by a series of uniform sections and calculate the transfer functions $M_{x,0}$, $Z_1M_{x,1}$, $H_{x,0}$ and $Z_1H_{x,1}$ for positive multiples of $f_1=1/t_w$. Set the functions to zero for frequency $f=0$ and, optionally, for frequencies above a selectable bandwidth $f_{bw}$.
3) Store the recorded surface torque and speed signals into circular memory buffers keeping the $n_s$ samples for each signal.
4) Apply the Fourier Transform to the buffered data on speed and torque, multiply the results by the appropriate transfer functions to determine the downhole speed and torque in the frequency domain, apply the Inverse Fourier Transform, and pick the center samples of the inverse transformed variables.

5) Add the mean surface speed to the dynamic speed, and a location-dependent mean torque to dynamic torque estimates, respectively.
6) Repeat the last two steps for every new updating of the circular data buffers.

The algorithm should not be construed as limiting the scope of the disclosure. A person skilled in the art will understand that one or more of the above-listed algorithm steps may be replaced or even left out of the algorithm. The estimated variables may further be used as input to the control unit 5 to control the top drive 31, typically via a not shown power drive and a speed controller, as e.g. described in WO 2013112056, WO 2010064031 and WO 2010063982, all assigned to the present applicant and U.S. Pat. Nos. 5,117,926 and 6,166,654 assigned to Shell International Research.

Testing and Validation

The methods described above are tested and validated in two ways as described below.

A comprehensive string and top drive simulation model has been used for testing the described method. The model approximates the continuous string by a series of lumped inertia elements and torsional springs. It includes non-linear wellbore friction and bit torque model. The string used for this testing is a two section 7500 m long string consisting of a 7400 m long 5 inch drill pipe section and a 100 m long heavy weight pipe section as the BHA. 20 elements of equal length are used, meaning that it treats frequencies up to 2 Hz fairly well. The wellbore is highly deviated (80° inclination from 1500 m depth and beyond) producing a high frictional torque and twist when the string is rotated. Only the case when $x=x_{bit}=7500$m is considered.

Figure 2:
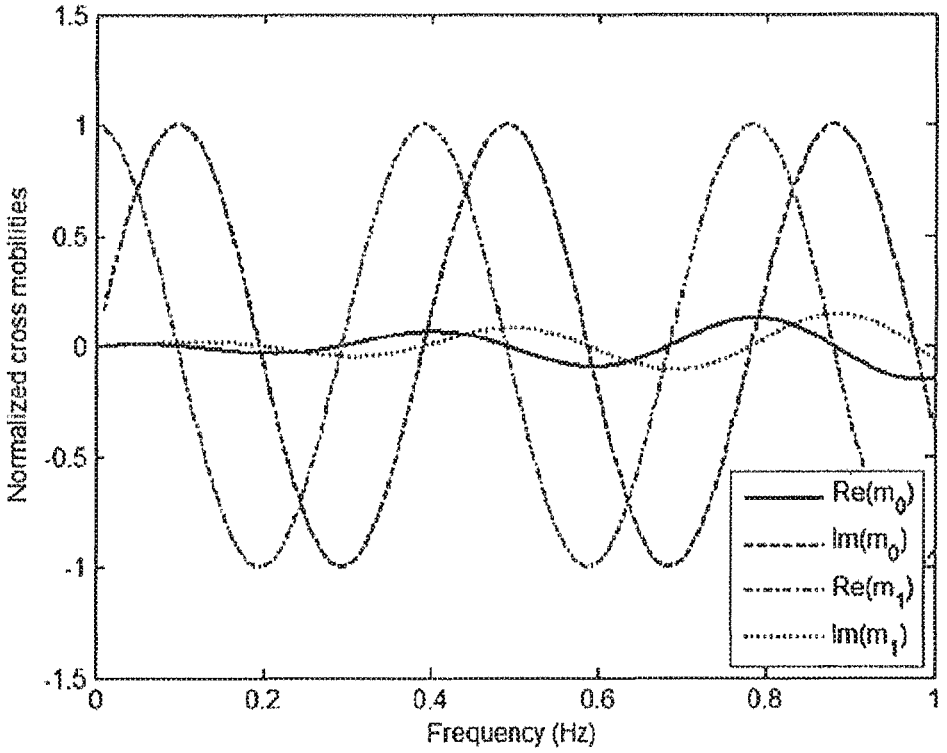
FIG. 2 is a graph showing the real and imaginary parts of normalized cross mobilities versus frequency.
Figure 3:
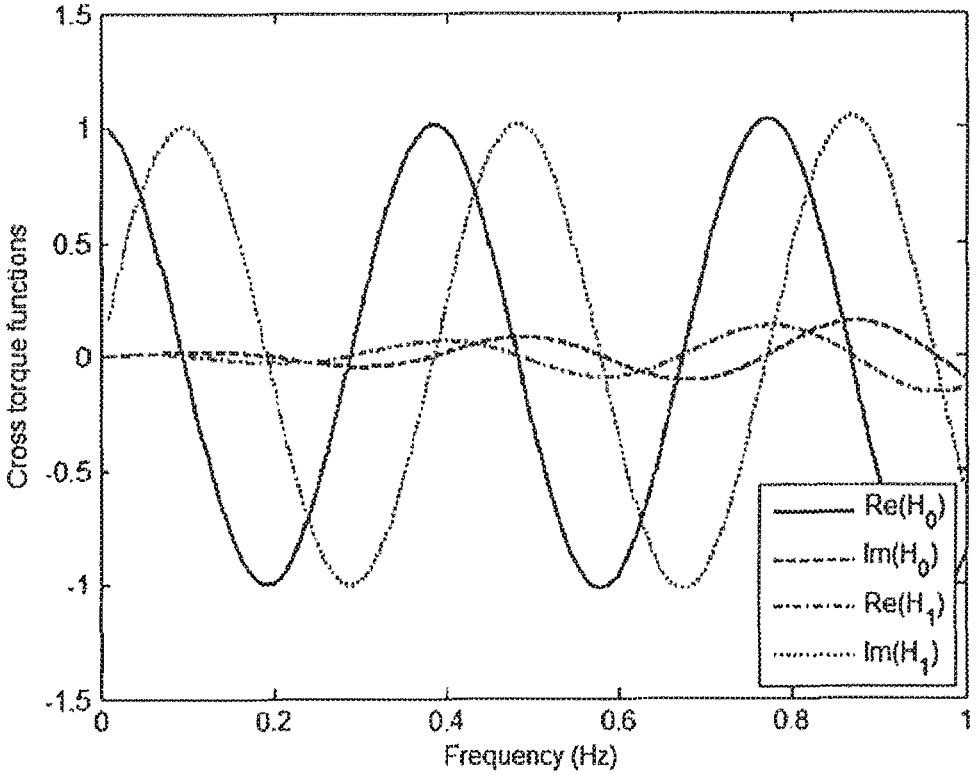
FIG. 3 is a graph showing the real and imaginary parts of torque transfer functions versus frequency.

Various transfer functions are visualized in FIGS. 2 and 3 by plotting their real and imaginary parts versus frequency. Separate curves for real and imaginary parts is an alternative to the more common Bode plots (showing magnitude and phase versus frequency) provide some advantages. One advantage is that the curves are smooth and continuous while the phase is often discontinuous. It is, however, easy to convert from one to the other representation by using of the well-known identities for a complex function: $z \equiv \mathrm{Re}(z) + j\mathrm{Im}(z) \equiv |z| e^{j\arg(z)}$.

The real and imaginary parts of the normalized cross mobilities $m_0=M_{x,0}Z_1$ and $m_1=M_{x,1}Z_1$ are plotted versus frequency in FIG. 2. The cross mobilities $M_{x,0}$ and $M_{x,1}$ are defined by equation (19) and the characteristic impedance factor is included to make $m_0$ and $m_1$ dimensionless. In short, the former represents the ratio of downhole rotation speed amplitude divided by the top torque amplitude in the special case when there are no speed variations of the top drive. For low frequencies (<0.2 Hz) $m_0$ is dominated by its imaginary part. It means that top torque and bit rotation speed are (roughly 90°) out of phase with each other. The latter mobility, $m_1$, can be regarded as a correction to the former mobility when the top drive mobility is non-zero, that is when there are substantial variations of the top drive speed.

Similarly, the various parts of the torque transfer functions $H_0$ and $H_1$ are visualized in FIG. 3. These functions are abbreviated versions of, but identical to, the transfer functions $H_{x,0}$ and $H_{x,1}$ defined by equation (20). The former represents the ratio of the downhole torque amplitude divided by the top torque amplitude, when the string is excited at the bit and the top drive is infinitely stiff (has zero mobility). Note that this function is basically real for low frequencies and that the real part crosses zero at about 0.1 Hz. The latter transfer function $H_1$ is also a correction factor to be used when the top drive mobility is not zero. Both $m_1$ and $H_1$ represent important corrections that are neglected in prior art techniques.

It is worth mentioning that all the plotted cross mobility and cross torque transfer functions are non-causal. It means that when they are multiplied by response variables like top torque and speed, they try to estimate what happened downhole before the surface response was detected. This seeming violation of the principle of causality is resolved by the fact that the surface based estimates for the downhole variables are delayed by a half the window time, $t_w/2$, which is substantially longer than the typical response time.

Half of the visualized components, some real and some imaginary, are very low at low frequencies but grow slowly in magnitude when the frequency increases. These components represent the damping along the string. They also limit the inverse (causal) transfer functions when the dominating component crosses zero.

Figure 4:
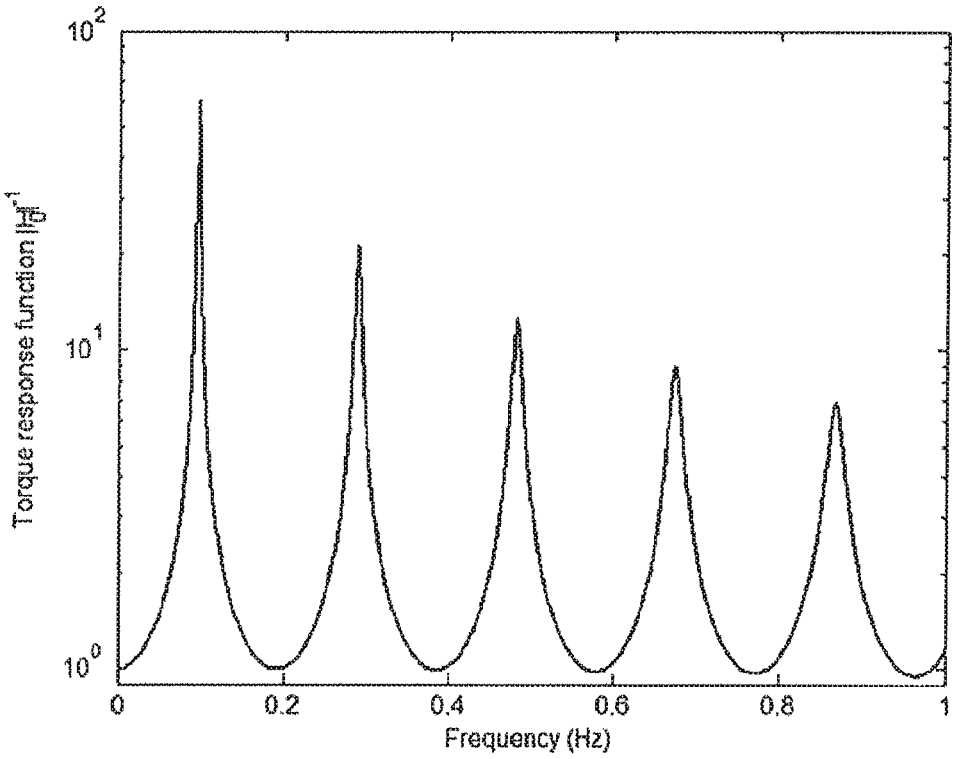
FIG. 4 is a graph showing torque response versus frequency.

The magnitude of the inverse cross torque $|H_0|^{-1}$ is plotted in FIG. 4 to visualize the string resonances with zero top drive mobility. The lowest resonance peak is found at 0.096 Hz, which corresponds to a natural period of 10.4 s. The lower peaks and increasing widths of the higher frequency resonances reflects the fact that the modelled damping increases with frequency.

Figure 5:
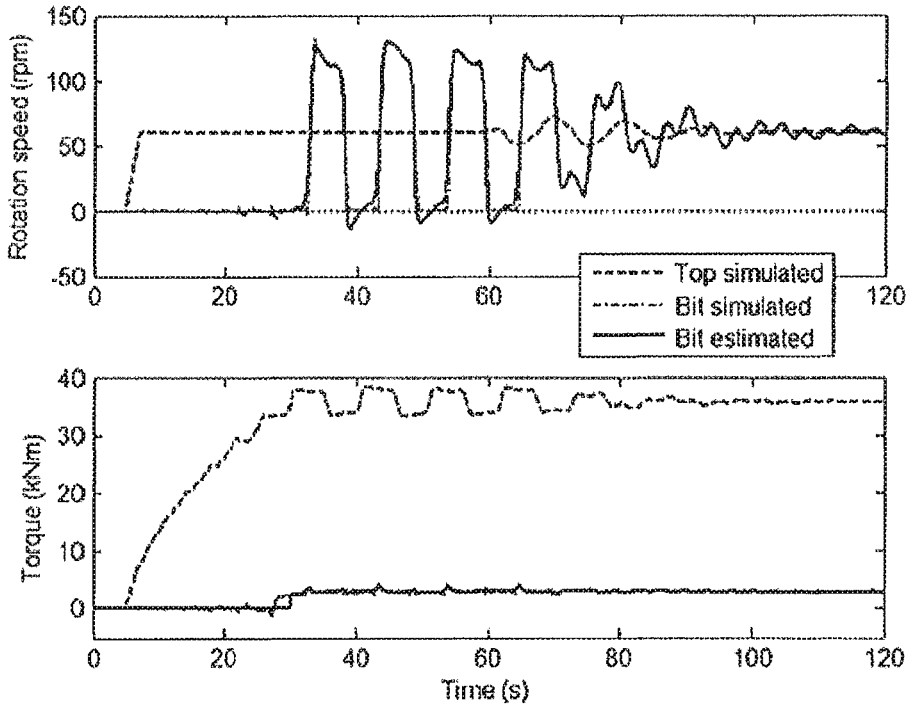
FIG. 5 is a graph showing simulated and estimated downhole variables versus time.

A time simulation with this string is shown in FIG. 5. It shows comparisons of "true" simulated downhole speeds and torque with the corresponding variables estimated by the method above. The test run consists of three phases, all with the string off bottom and with no bit torque. The first phase describes the start of rotation while the top drive, after a short ramp up time, rotates at a constant speed of 60 rpm. The top torque increases while the string twists until the lower end breaks loose at about 32 s. The next phase is a stick-slip phase where the downhole rotation speed varies from virtually zero to 130 rpm, more than twice the mean speed. These stick-slip oscillations come from the combination of non-linear friction torque, high torsional string compliance and a low mobility (stiffly controlled) top drive. At 60 s the top drive speed controller is switched to a soft (high mobility) control mode, giving a normalized top drive mobility of 0.25 at the stick-slip frequency. This high mobility, which is seen as large transient speed variations, causes the torsional oscillations to cease, as intended.

The simulated surface data are carried through the algorithm described above to produce surface-based estimates of downhole rotation speed and torque. The chosen time base window is 10.4 s, equal to the lowest resonance period. A special logic, briefly mentioned above, is used for excluding downhole variations before the surface torque has crossed its mean rotating off-bottom value (38 kNm) for the first time. If this logic had not been applied, the estimated variable would contain large errors due to the fact that the wellbore friction torque is not constant but varies a lot during twist-up.

The match of the estimated bit speed with the simulated speed is nearly perfect, except at the sticking periods when the simulated speed is zero. This mismatch is not surprising because the friction torque in the lower (sticking) part of the string is not a constant as presumed by the estimation method. The simulated estimated downhole torque is not the bit torque but the torque at x=7125m, which is the depth at the interface between the two lowest elements. The reason for not using the bit torque is that the simulations are carried out with the bit off bottom thus producing no bit torque.

Figure 6:
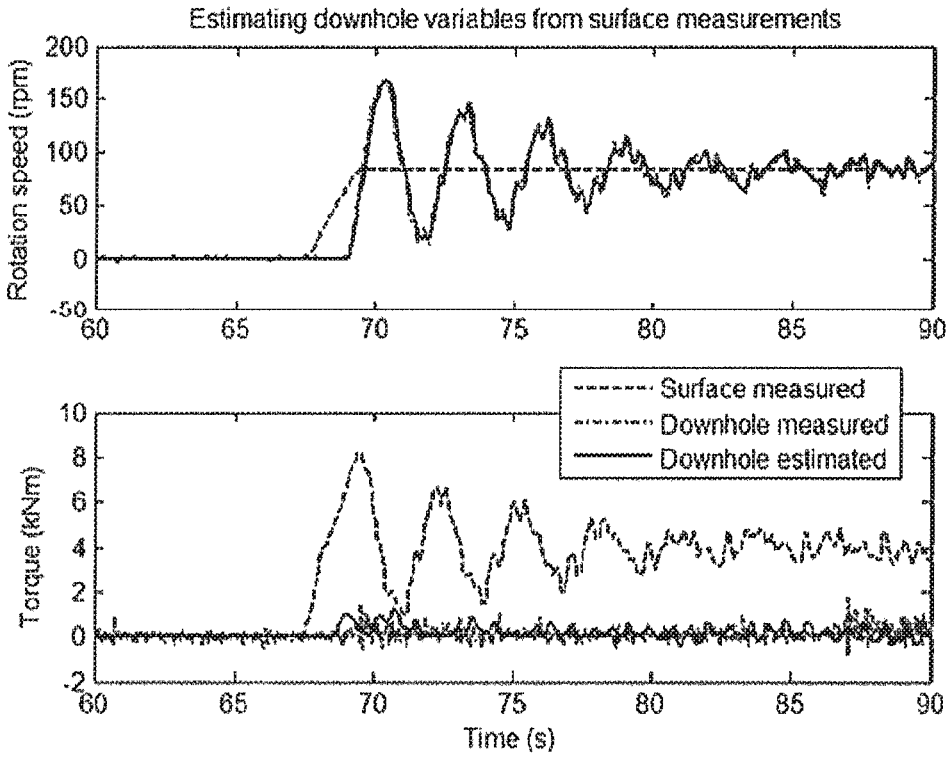
FIG. 6 is a graph showing estimated and measured downhole variables versus time.
Figure 7:
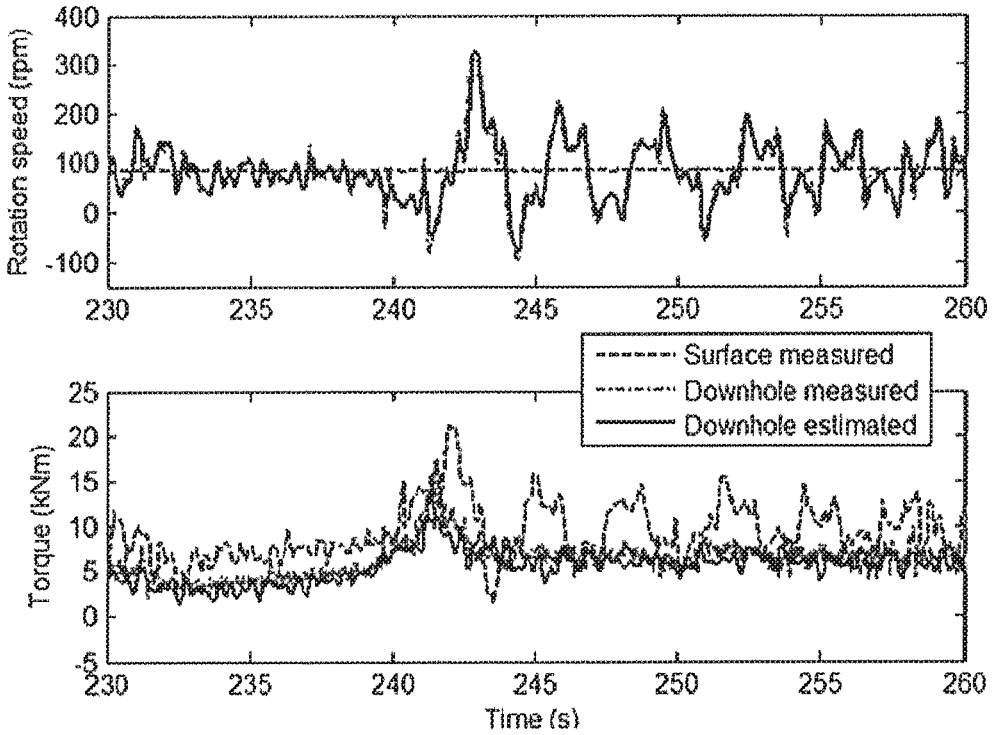
FIG. 7 is a graph showing estimated and measured downhole variables versus time during drilling.

The new method disclosed herein has also been tested with high quality field data, including synchronized surface and downhole data. The string length is about 1920 m long and the wellbore was nearly vertical at this depth. References are made to FIGS. 6 and 7. FIG. 6 shows the results during a start-up of string rotation when the bit is off bottom. The dashed curves represent measured top speed and top torque, respectively, while the dash-dotted curves are the corresponding measured downhole variables. These downhole variables are captured by a memory based tool called EMS (Enhance Measurement System) placed near the lower string end. The black solid lines are the downhole variables estimated by the above method and based on the two top measurements and string geometry only. FIG. 7 shows the same variables over a similar time interval a few minutes later, when the bit is rotated on bottom. The test string includes a mud motor implying that the bit speed equals the sum of the string rotation speed and the mud motor speed. The higher torque level observed in FIG. 7 is due to the applied bit load (both axial force and torque). Both the measured and the estimated speeds reveal extreme speed variations ranging from −100 rpm to nearly 400 rpm. These variations are triggered and caused by erratic and high spikes of the bit torque. These spikes probably make the bit stick temporarily while the mud motor continues to rotate and forces the string above it to rotate backwards.

The good match between the measured and estimated downhole speed and torques found both in the simulation test and in the field test are strong validations for the new estimation method.

What is claimed is:

1. A non-transitory computer readable medium encoded with instructions that, when executed by a control unit, cause the control unit to:

a) use geometry and elastic properties of a drill string to calculate transfer functions describing frequency-dependent amplitude and phase relations between cross combinations of speed and force variables at the surface (surface variables) and downhole;

b) select a base time period that is at least as long as a period of fundamental drill string resonance;

c) measure surface speed and force variables, condition said measured data, and store the conditioned data at least over a last elapsed base time period; and d) calculate the downhole variables in the frequency domain by applying an integral transform of the surface variables, multiply results of the calculation with said transfer functions, apply an inverse integral transform to sums of coherent terms and pick points in said base time period to get time-delayed estimates of downhole speed and force variables.

2. The computer readable medium of claim 1, wherein the control unit is to estimate general variables representing one or more of the following pairs:

torque and rotation speed;

tension force and axial velocity; and pressure and flow rate.

3. The computer readable medium of claim 1, wherein the control unit is to add mean values to said estimates of the speed and force variables.

4. The computer readable medium of claim 1 wherein, to perform a), the control unit is to approximate said drill string by a series of uniform sections.

5. The computer readable medium of claim 1, wherein, to perform C), the control unit is to store data in circular buffers.

6. The computer readable medium of claim 1, wherein, to perform c), the control unit is to filter out data from start-up of a drill string moving means.

7. The computer readable medium of claim 6, wherein, to filter out start-up data, the control unit is to set the speed equal to zero until a mean force variable reaches a mean force measured prior to a last stop of said drilling string moving means.

8. The computer readable medium of claim 1, wherein, to perform b), the control unit is to select a base time period representing an inverse of a fundamental frequency of a series of harmonic frequency components of said drill string.

9. The computer readable medium of claim 1, wherein, to perform d), the control unit is to pick points at or near a center of said base time period.

10. The computer readable medium of claim 1, wherein, to perform a), the control unit is to calculate an effective characteristic impedance of a selected mode of said drill string.

11. The computer readable medium of claim 10, wherein, to calculate said effective characteristic mechanical impedance of said drill string, the control unit is to add a tool joint correction factor to a pipe impedance factor to account for pipe joints in said drill string.

12. The computer readable medium of claim 11, wherein the control unit is to use said pipe joint correction factor to calculate a wave number of a pipe section in said drill string, and wherein the control unit is to add a damping factor to said wave number to account for linear damping along said drill string.

13. The computer readable medium of claim 12, wherein, to account for said linear damping, the control unit is to add a frequency-dependent and/or a frequency-independent damping factor.

14. The computer readable medium of claim 2, wherein, to perform c), the control unit is to measure tension force and axial velocity in a deadline anchor and/or in a draw works drum, and to account for inertia of moving mass prior to storing the data.

15. A system for estimating downhole speed and force variables at an arbitrary location of a moving drill string based on surface measurements of the speed and force variables, the system comprising:

a drill string moving means for moving said drill string in a borehole;

a speed sensor configured to sense the speed at or near the surface of said borehole;

a force sensor configured to sense the force at or near the surface of said borehole;

a control unit configured to sample, process and store, at least temporarily, data collected from said speed and force sensors, the control unit further configured to:

use geometry and elastic properties of said drill string to calculate transfer functions describing frequency-dependent amplitude and phase relations between cross combinations of said speed and force variables at the surface (surface variables) and downhole;

select, or receive as an input, a base time period;

condition data collected by said speed and force sensors, and store the conditioned data at least over the last elapsed base time period; and calculate the downhole variables in the frequency domain by applying an integral transform of the surface variables, multiplying results of downhole variable calculation with said transfer functions, applying an inverse integral transform to sums of coherent terms, and picking points in said base time period to get time-delayed estimates of the speed and force variables.

16. The system of claim 15, wherein the integral transform is a Fourier transform.

17. The system of claim 15, wherein the control unit is configured to filter out data from start-up of the drill string moving means.

18. The system of claim 17, wherein to filter out the data, the control unit is configured to set speed equal to zero until a mean force variable reaches a mean force measured prior to a last stop of said drilling string moving means.

19. The system of claim 15, wherein the control unit is configured to select the base time period as an inverse of a fundamental frequency of a series of harmonic frequency components of said drill string.

20. The system of claim 15, wherein the control unit comprises a non-transitory computer readable medium encoded with instructions that, when executed by the control unit, cause the control unit to:

a) use geometry and elastic properties of a drill string to calculate transfer functions describing frequency-dependent amplitude and phase relations between cross combinations of speed and force variables at the surface (surface variables) and downhole;

b) select a base time period that is at least as long as a period of fundamental drill string resonance;

c) measure surface speed and force variables, condition said measured data, and store the conditioned data at least over a last elapsed base time period; and d) calculate the downhole variables in the frequency domain by applying an integral transform of the surface variables, multiply results of the calculation with said transfer functions, apply an inverse integral transform to sums of coherent terms and pick points in said base time period to get time-delayed estimates of downhole speed and force variables.

* * * * *